United States Patent [19]

Petroski

[11] 4,044,930

[45] Aug. 30, 1977

[54] HAND GUN HOLSTER

[76] Inventor: Daniel J. Petroski, 2130 Campbell Road, Houston, Tex. 77055

[21] Appl. No.: 578,521

[22] Filed: May 19, 1975

[51] Int. Cl.[2] ..... F41C 33/00

[52] U.S. Cl. ..... 224/2 C; 224/5 A; 248/309 R

[58] Field of Search ..... 224/2 C, 5 A, 26 R, 224/1 R, 5 R, 2 B, 2 D; 248/102, 104, 105, 309 R, 311, 314, 315

[56] References Cited

U.S. PATENT DOCUMENTS

| | | | |
|---|---|---|---|
| 222,899 | 12/1879 | Hartman | 224/1 R |
| 636,295 | 11/1899 | Sibthorpe | 224/1 R |
| 969,524 | 9/1910 | Condon | 224/1 R |
| 1,166,781 | 1/1916 | Parrish | 224/2 C |
| 2,907,539 | 10/1959 | Vardan | 248/104 |
| 3,227,336 | 1/1966 | Dickey | 224/2 B |
| 3,379,349 | 4/1968 | Hier | 224/2 B |
| 3,642,184 | 2/1972 | Hendricks | 224/2 C |
| 3,798,712 | 3/1974 | Bonis | 224/5 A X |

*Primary Examiner*—Robert J. Spar
*Assistant Examiner*—Jerold M. Forsberg

[57] ABSTRACT

A smooth support strap adapted to be vertically positioned between a trouser waistband and the body of a wearer, the support strap having integrally formed therewith a metal plate for maintaining in a bended down position a portion of the support strap in order to form a downward depending hook for engaging a belt or waistband of the wearer. A barrel-receiving loop is carried by the remaining vertical portion of the support strap for supporting a handgun.

6 Claims, 6 Drawing Figures

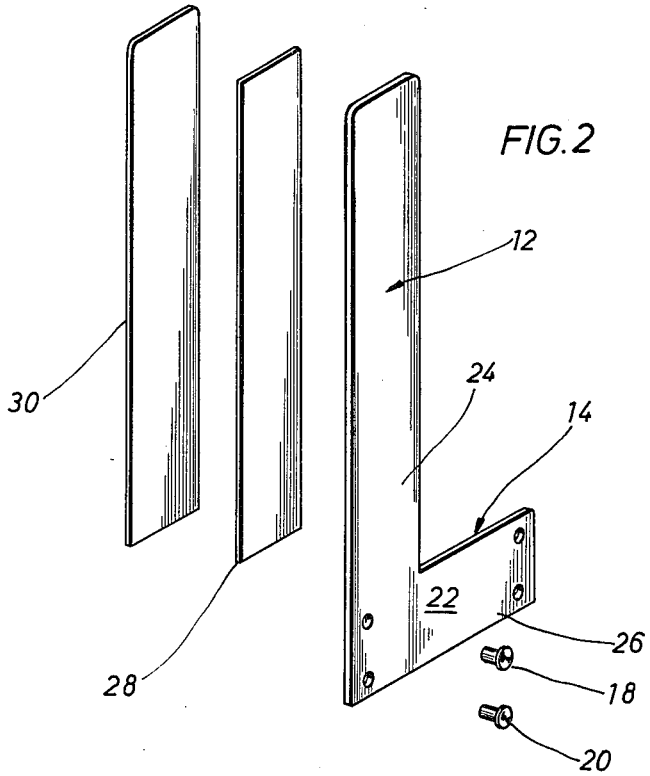
FIG. 2
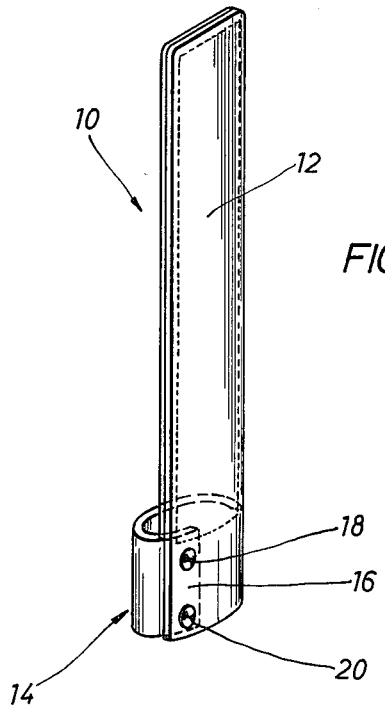
FIG. 1
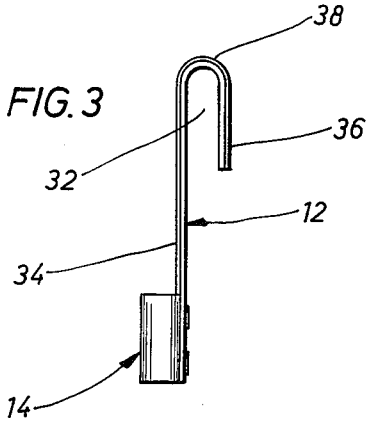
FIG. 3
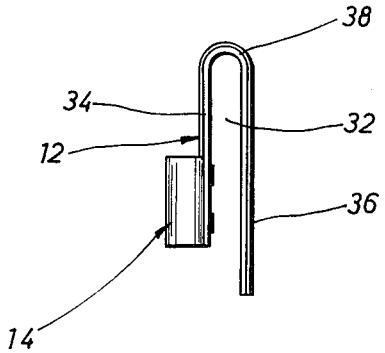
FIG. 4
FIG. 6
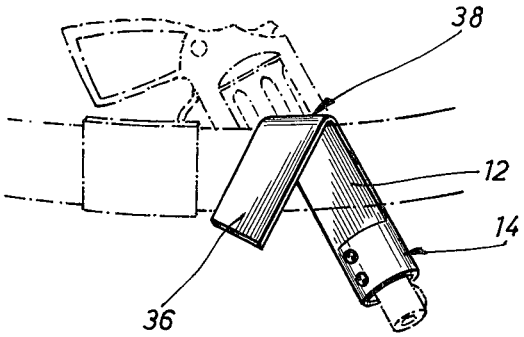
FIG. 5
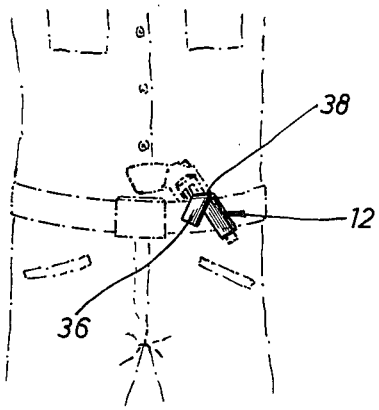

HAND GUN HOLSTER

BACKGROUND OF THE INVENTION

This invention relates generally to a novel hand gun holster. More particularly, this invention relates to an improvement in holsters of the type used for carrying revolver type pistols. The holster of the present invention will find particular usefulness in instances where it is desired to support a hand gun between the belt or trouser waistband and the body of the wearer.

The present invention is an improvement in the holster of the type disclosed in U.S. Pat. No. 3,227,336 to Dickey. Holsters of this type are used to support hand guns used by undercover police agents who desire to carry such weapons out of view in a most inconspicuous manner as possible. Most typically, the hand gun will be supported under the belt or waistband of the trousers of the wearer, that is, between the waistband of the trousers and the body.

In the past, holsters have been used which engage only the barrel portion of revolver type hand guns. These holsters would comprise a strap, an S-shaped belt clip which would attach to the strap, a cylindrical, barrel-receiving loop, and a shield or guard which is attachable to a portion of the loop. The hand gun could be placed in the holster by inserting the barrel of the gun into the loop until further downward movement would be arrested by either the trigger guard of the hand gun or an enlarged portion of the barrel coming into contact with the loop. Typically the loop would be only slightly larger than the diameter of the barrel of the gun and would extend along a portion of the barrel a distance much less than the length of a conventional hand gun barrel.

In the holster disclosed in U.S. Pat. No. 3,227,336 referred to above, an S-shaped clip is inserted through a slot in the strap of the holster, and the clip is intended to engage the belt or waistband of the trousers. The S-shaped clip is apparently of fixed geometry and, hence, may accommodate users whose belts and/or trousers are of standard thickness. That is, such an arrangement may be quite unsatisfactory if the wearer were to use a very thick belt or if the wearer were to attempt to carry a gun while wearing less conventional clothes.

Moreover, inasmuch as a variety of revolver designs are available for use by police officers, it is possible that certain revolvers would sit either too high or too low in the holster and, hence, might not be conveniently used by a police officer engaged in undercover work. Furthermore, if the hand gun rested in an uncomfortable position against the body or underclothes of the wearer, the only alternative available under the prior art would be to move the holster to a new circumferential position on the belt or waistband. That is, the holster could not be adjusted upwardly or downwardly at a desired location along the belt or waistband.

The holster disclosed in the above referenced patent utilizes a strap having a horizontal slot into which the S-shaped clip is inserted. It may be found that after a period of time, this slot may rip or tear by virtue of the forces imposed upon it by the S-shaped clip. It is believed that such a slot represents a weakened area in the strap and may result in undesirable consequences after repeated use.

Moreover, it may be found that the S-shaped clip has tendancy to tear the underclothes or scratch the skin of the user.

It would therefore be desirable to provide a hand gun holster which is not susceptible to tearing along a surface of the strap or to a tearing of underclothes or a scratching of the user. In addition, it would be desirable to provide a hand gun holster which could readily be adjusted upwardly or downwardly at a fixed location along a belt or trouser waistband of the wearer and provide a means for adjustment to facilitate the comfortably carrying of a hand gun at a desired circumferential position along a belt or trouser waistband.

It is therefore a general object of the present invention to provide a novel improvement in a hand gun holster which minimizes or reduces the problems of the type previously noted.

It is a more particular object of the present invention to provide a novel hand gun holster which is adjustable to accommodate hand guns of varying dimensions.

It is another object of the present invention to provide a novel hand gun holster which may be positionally adjusted at a given location along a belt or trouser waistband of the wearer.

It is yet another object of the present invention to provide a novel hand gun holster which may be carried by any thickness of belt or trouser waistband.

A hand gun holster according to a preferred embodiment of the invention intended to substantially accomplish the foregoing objects includes a substantially smooth leather support strap adapted to be vertically positioned between a trouser waistband and the body or underclothes of a wearer of the trousers. A metal plate is integrally formed with the support strap for bending a portion of the support strap into a downward depending hook in order to engage a belt or waistband of the trousers. A barrel-receiving loop is carried by the support strap for supporting the hand gun. This loop is operable to receive only the barrel portion of the hand gun and provides essentially the only support for the hand gun.

There are other objects, features, and advantages of the present invention which will become apparent with reference to the following detailed description of a preferred embodiment thereof in connection with the accompanying drawings wherein like reference numerals have been applied to like elements, in which:

BRIEF DESCRIPTION OF THE DRAWINGS

FIG. 1 is a plan view of a hand gun holster according to the present invention;

FIG. 2 is an exploded view of the holster of FIG. 1 prior to assembly thereof;

FIG. 3 is a pictorial view of the holster of FIG. 1 wherein the support strap has been bent into a downward depending hook operable to support a hand gun in a first position on the wearer;

FIG. 4 pictorially depicts the holster of FIG. 3 wherein the support strap has been bent to a downward depending hook in a manner to support a hand gun in a second position on a wearer;

FIG. 5 and 6 pictorially illustrates a manner in which the holster of the present invention may be used to support a hand gun in a tilted position.

As may be seen in FIG. 1, a hand gun holster 10 is provided according to the present invention preferably having a leather support strap 12 and a leather gun barrel-receiving loop 14 attached to a bottom end 16 of the strap 12. The barrel-receiving loop 14 may be integrally formed from a single piece of leather as shown in FIGS. 1 and 2. The loop 14 may be secured to the strap 12 by rivets 18 and 20 or other appropriate means.

As may be seen in FIG. 2, the strap portion 12 of the holster 10 comprises an L-shaped piece of leather 22, the vertical portion 24 of which forms a portion of the support strap 12 and a horizontal portion 26, which when moved into a position as shown in FIG. 1, forms the loop 14 of the holster. A metal plate 28 is sandwiched between the vertical portion 24 and a rectangularly shaped piece of leather 30 which is stitched to the vertical portion by any conventional means. Preferably the metal plate should extend along the entire length of the vertical portion 24 which comprises the support strap 12.

The metal plate 28 is fashioned from a rigid but yielding material which facilitates the bending of the support strap into a downward depending hook as shown in FIG. 3. In particular, in a preferred form of the invention, the metal plate is fabricated from 3/32 inch aluminum. However, it is contemplated that other metals displaying similar characteristics may be used.

As may be seen in FIGS. 3 and 4, the interspace 32 between the remaining vertical portion 34 of the strap and the bent around portion 36 which forms the downward depending hook 38 may be variously adjusted to accommodate belts of varying thicknesses. When the hook 38 is positioned over a trouser waistband or belt or both, a particularly secure fit may be accomplished by squeezing together the bent-around portion 36 and the remaining vertical portion 34 of the support strap 12.

As may be seen in slightly exaggerated form in FIG. 4, in some instances it may be desirable to position the hand gun in not quite as deep a position as would occur with the arrangement in FIG. 3. In such instances the support strap 12 may be bent at a location nearer to the loop 14 thereby raising the loop to a position closer to the trouser waistband or belt of the wearer. In instances where the hand gun being carried is relatively small or where it becomes more comfortable for the wearer, the configuration depicted in FIG. 4 may be more desirable than that depicted in, say, FIG. 3. In any event, the holster of the present invention is variously adjustable as to depth or distance between the loop 14 and the U-bend or hook 38. It will be appreciated that such adjustability facilitates the carrying of hand guns of various dimensions and, in addition, enables the wearer to make minor adjustments which may facilitate carrying the hand gun in a more comfortable manner.

As shown in FIGS. 5 and 6, the hook 38 formed by the bent around portion 36 of the support strap 12 need not remain aligned with the remaining vertical portion 34 of the support strap. The bent around portion 36 may be twisted slightly in order to permit a wearer to position a hand gun in a tilted attitude for convenience in withdrawing the hand gun from the holster or to provide a more comfortable positioning of the hand gun beneath the trousers of the wearer. It may be found in some persons that it is more comfortable to position a hand gun carried in the manner of the present invention just forward of the ilium or hip bone in which instances tilting the hand gun may provide for a naturally more comfortable nesting of the weapon against the body of the wearer, as shown in FIGS. 5 and 6.

It will be appreciated that the holster 10 of the present invention may be fabricated from materials other than leather. For example, certain plastics may display the appropriate characteristics to be suitable material for such a holster. As noted above, the rigid and yielding metal plate 28 sandwiched between the two pieces of leather 30 and 24 may be comprised of a variety of alloys which display appropriate bending characteristics.

In constructing a hand gun holster according to the present invention, certain significant advantages are provided. For example, the hook 38 formed by the bent-around portion 36 of the support strap 12 may be manipulated to accommodate virtually all known belts or may be used with less conventional apparel. For example, the holster is operable to carry a hand gun in a relatively high or low position beneath trousers having either a very high or very low cut waistband. The adjustability feature of the holster permits each wearer to literally custom fit the holster to his particular physique and selection of hand gun.

It is believed therefore, that the holster of the present invention may be significantly more comfortable and useful than known devices.

In addition, inasmuch as no slots need be made in the leather or other material from which the holster is manufactured, an undesirable tearing of the support strap or other portion is less likely to occur. The support strap 12 is substantially smooth and the hook 38 which is formed from the strap 12 is free from sharp edges or corners.

Thus it is apparent that there has been provided, in accordance with the invention, a hand gun holster that substantially satisfies the objects and advantages set forth above. Although the present invention has been described in conjunction with a specific form thereof, it is evident that many alternatives, modifications and variations will be apparent to those skilled in the art in light of the foregoing disclosure of the invention. Accordingly, it is intended that all such alternatives, modifications and variations which fall within the spirit and scope of the invention as defined in the appended claims be embraced thereby.

What is claimed is:

1. A variously adjustable holster for carrying a hand gun between a waistband of a pair of trousers and the wearer thereof, said holster comprising:

a hand gun barrel-receiving loop for supporting a handgun in a position beneath the waistband of a user at a selected distance from the waistband and and a selected angle in relation thereto;

adjustment means for providing distance and angular adjustment of said loop in relation to the waistband, said adjustment means comprising:

a substantially smooth strap for supporting said loop;

a metal plate internally disposed within said strap and cooperable therewith over substantially an entire length thereof;

said adjustment means being selectively manually bendable into a generally downwardly depending U-shaped hook operable to engage a belt or waistband, said hook comprising:

a first portion comprising a first length of said strap extending between said loop and a bend in said strap; and a second portion comprising a second length of said strap extending from the bend in said strap to an end of said strap opposite said loop;

the length of said first and said second portions being variable to position said loop at a selected distance in relation to the waistband;

the alignment of said first and said second portions being variable to position said loop at a selected angle in relation to the waistband, the selected angle ranging from a forward slanting position to a rearward slanting position.

2. The holster of claim 1 wherein said metal plate is aluminum.

3. The holster of claim 1 wherein said metal plate is intermediately positioned between two separate lengths of material comprising said support strap.

4. The holster of claim 1 wherein said support strap and said loop are integrally formed from a L-shaped piece of material.

5. The holster of claim 1 wherein said loop is fastened to said support strap by means of rivets.

6. The holster of claim 5 wherein said loop comprises a length of material integrally formed with said support strap.

* * * * *